US008197190B2

(12) United States Patent
Garcin et al.

(10) Patent No.: US 8,197,190 B2
(45) Date of Patent: Jun. 12, 2012

(54) LEVER FOR ROTATING A TURBOMACHINE VARIABLE-PITCH STATOR VANE ABOUT ITS PIVOT

(75) Inventors: Francois Maurice Garcin, Paris (FR); Pierrick Bernard Jean, Paris (FR); Jean-Pierre Francois Lombard, Pamfou (FR); Christian Paleczny, Paris (FR)

(73) Assignee: SNECMA, Paris (FR)

( * ) Notice: Subject to any disclaimer, the term of this patent is extended or adjusted under 35 U.S.C. 154(b) by 879 days.

(21) Appl. No.: 12/207,009

(22) Filed: Sep. 9, 2008

(65) Prior Publication Data

US 2009/0074569 A1 Mar. 19, 2009

(30) Foreign Application Priority Data

Sep. 13, 2007 (FR) ..... 07 06431

(51) Int. Cl.
*F01D 25/04* (2006.01)

(52) U.S. Cl. ..... 415/119; 415/160; 156/73.6; 74/519

(58) Field of Classification Search ..... 415/160, 415/119; 74/519; 156/73.6
See application file for complete search history.

(56) References Cited

U.S. PATENT DOCUMENTS 3,874,711 A * 4/1975 Scalzo et al. ..... 285/236
4,773,821 A * 9/1988 Gonthier et al. ..... 415/150
5,311,736 A * 5/1994 Lardellier ..... 60/226.3
5,695,867 A * 12/1997 Saitoh et al. ..... 428/219
6,177,173 B1 * 1/2001 Nelson ..... 428/137
6,881,029 B2 * 4/2005 Le Biez et al. ..... 415/173.4
7,983,008 B2 * 7/2011 Liao et al. ..... 360/294.4
2006/0062667 A1 * 3/2006 Bourgoin et al. ..... 415/199.1
2009/0324418 A1 * 12/2009 Christofi et al. ..... 416/241 R

FOREIGN PATENT DOCUMENTS

EP 1 010 918 A2 6/2000
EP 1 111 196 A2 6/2001
EP 1 820 941 A1 8/2007

* cited by examiner

*Primary Examiner* — Steven Loke
*Assistant Examiner* — Victoria Hall
(74) *Attorney, Agent, or Firm* — Oblon, Spivak, McClelland, Maier & Neustadt, L.L.P.

(57) ABSTRACT

A lever for rotating about its pivot a turbomachine variable-pitch stator vane: including a first zone for attachment to a lever drive member, a second zone for attachment to the variable-pitch stator vane, and a third zone of elongate shape between the first zone and the second zone is disclosed. A vibration-damping laminate is applied to at least one surface portion of at least one of the zones of the lever. The laminate includes at least one layer of viscoelastic material in contact with the surface portion and a backing layer of rigid material.

10 Claims, 3 Drawing Sheets

LEVER FOR ROTATING A TURBOMACHINE VARIABLE-PITCH STATOR VANE ABOUT ITS PIVOT

BACKGROUND OF THE INVENTION AND DESCRIPTION OF THE PRIOR ART

The present invention relates to turbomachines such as those used in the field of aeronautical engineering. It relates to the variable-pitch stator vanes of turbomachines, particularly of gas turbine engine compressors, and more especially to the control levers that rotate such vanes about their pivot.

Gas turbine engines comprise an air-compressor-forming section feeding a combustion chamber which produces hot gases which, downstream, drive the turbine stages. The engine compressor comprises a plurality of moving bladed disks or blisks, separated by successive stages of stator blisks that straighten the gaseous flow. The vanes of the first flow straightener stages are generally variable-pitch vanes, that is to say that the angular position of the vane about its radial axis, that acts as a pivot, can be adjusted according to mission points in order to improve compressor efficiency. The variable-pitch vanes are oriented using a mechanism known as a variable-pitch mechanism or a VSV which stands for variable stator vane. There are various designs of such mechanisms, but on the whole, they all comprise one or more actuators fixed to the engine casing, synchronization bars or a control shaft, rings surrounding the engine and positioned transversely with respect to the axis thereof, and substantially axial levers also known as pitch control rods, connecting the rings to each of the variable-pitch vanes. The actuators rotate the rings about the engine axis and these cause all the levers to turn synchronously about the vane pivots.

These mechanisms are subjected both to the aerodynamic loads applied to the vanes, which are high, and to loads resulting from friction in the various connections. In particular, the levers are subjected to static loadings in bending and in torsion and to dynamic stresses. All of these loads may reach levels liable to be damaging; in particular, their combined effect may lead to the formation of cracks or to other damage. Given the mechanical strength and endurance requirements attributed to them, the amplitudes of any vibrations caused by these loads, and to which these components are subjected, need to remain small.

The components are designed and engineered in such a way as to avoid there being any critical modes in their operating range. However, in practice, there are still some overlaps and experience, during engine testing carried out at the end of the component design cycle, has revealed that, in some cases, that could lead to cracks being formed in the levers. The component has then to be re-engineered and modified, this being a particularly lengthy and expensive process. It is therefore necessary to predict the vibrational response levels as early on as possible in the component engineering cycle so that the necessary corrective measures can be taken as early on as possible in the design process.

SUMMARY OF THE INVENTION

One object of the present invention is to provide structural damping with a view to reducing the levels of deformation experienced by these components during operation and, more specifically, to attenuate the dynamic responses of levers used to rotate a variable-pitch vane under synchronous or asynchronous stress, be it of aerodynamic origin or otherwise, by providing dynamic damping.

The invention thus relates to a lever for rotating about its pivot a turbomachine variable-pitch stator vane comprising three zones: a first zone for attachment to a lever drive member, a second zone for attachment to said variable-pitch stator vane, and a third zone of elongate shape between the first zone and the second zone. The lever according to the invention is one wherein a vibration-damping laminate is applied to at least one surface portion of at least one of said zones of the lever, the laminate comprising at least one layer of viscoelastic material in contact with said surface portion and a backing layer of rigid material.

The drive member is generally a ring surrounding the turbomachine casing, and itself rotated about the axis of this turbomachine by an actuator. The lever is generally mounted at the end of the vane so as to turn the vane via its platform.

The laminate is either bonded onto said surface portion or kept pressed against it by a mechanical means.

In order to guarantee the robustness of these components with respect to vibrational fatigue, the solution of the invention is therefore to add to the structure specific devices capable of dissipating vibrational energy.

The novelty of the present invention lies in its use of tile-like laminates made up of a viscoelastic sandwich with a stress layer which are bonded or fixed to the structure, and the function of which is to dissipate the vibrational energy of the component.

The dissipation of this part of the energy is obtained by shear deformation of the viscoelastic material, between the structure which deforms under dynamic stressing and the stress layer carried along by inertia. These tile-like laminates, by being fixed or bonded to the faces of the lever, directly damp the modes of the structure, without disrupting the overall performance of the machine.

The solution of the invention has the advantage of allowing the structural damping of the metal component in question to be increased without having to re-engineer it, and therefore of reducing the development and optimization costs and time associated with the product.

It also makes it possible to broaden the conventional design domains restricted by the need to meet reverse-cycle loading requirements and, indirectly, allows weight savings.

The invention can be applied irrespective of the type of dynamic loading: overlap with engine harmonics or asynchronous excitation.

According to one embodiment of the invention, said zone of the lever to which the laminate is applied is the third zone. According to technical considerations, said surface portion to which the vibration-damping laminate is applied entirely covers said third zone.

According to another embodiment, said zone of the lever comprises the second and third zones.

According to another embodiment, with the lever comprising a radially upper face and a radially lower face, the laminate is applied to at least one surface portion of said radially lower or upper faces. For example, at least one of said radially lower or upper faces is a flat face.

According to another embodiment, with the second zone of the lever comprising a face at a level radially different than a face of the third zone, the vibration-damping laminate at least partially covers a surface portion of said face of the second zone and a surface portion of said face of the third zone. More particularly, the laminate comprises an intermediate part, between said second zone surface portion and said third zone surface portion. Said intermediate part of the vibration-damping laminate may possibly be holed.

According to one embodiment, the vibration-damping laminate is in the form of a strip of a width narrower than the width of the third zone. The lever may possibly comprise at least two strips of vibration-damping laminate. More specifically, the lever comprises at least two strips of vibration-damping laminate which are positioned parallel to one another.

According to one embodiment, the laminate is made up of a stack of viscoelastic layers and of rigid layers in alternation, and the characteristics of the viscoelastic material vary from one layer to another or alternatively, the characteristics of the viscoelastic material are the same from one layer to another and the characteristics of the rigid material vary from one layer to another, or alternatively the characteristics of the rigid material are the same from one rigid layer to another.

The invention also relates to a turbomachine comprising at least one such lever for rotating a variable-pitch stator vane about its pivot. More specifically, it is a gas turbine engine compressor comprising at least one lever such as this for rotating a variable-pitch flow straightener vane about its pivot.

BRIEF DESCRIPTION OF THE DRAWINGS

The invention is now described in greater detail with reference to the attached drawings in which.

DESCRIPTION OF THE PREFERRED EMBODIMENTS

Figure 1:
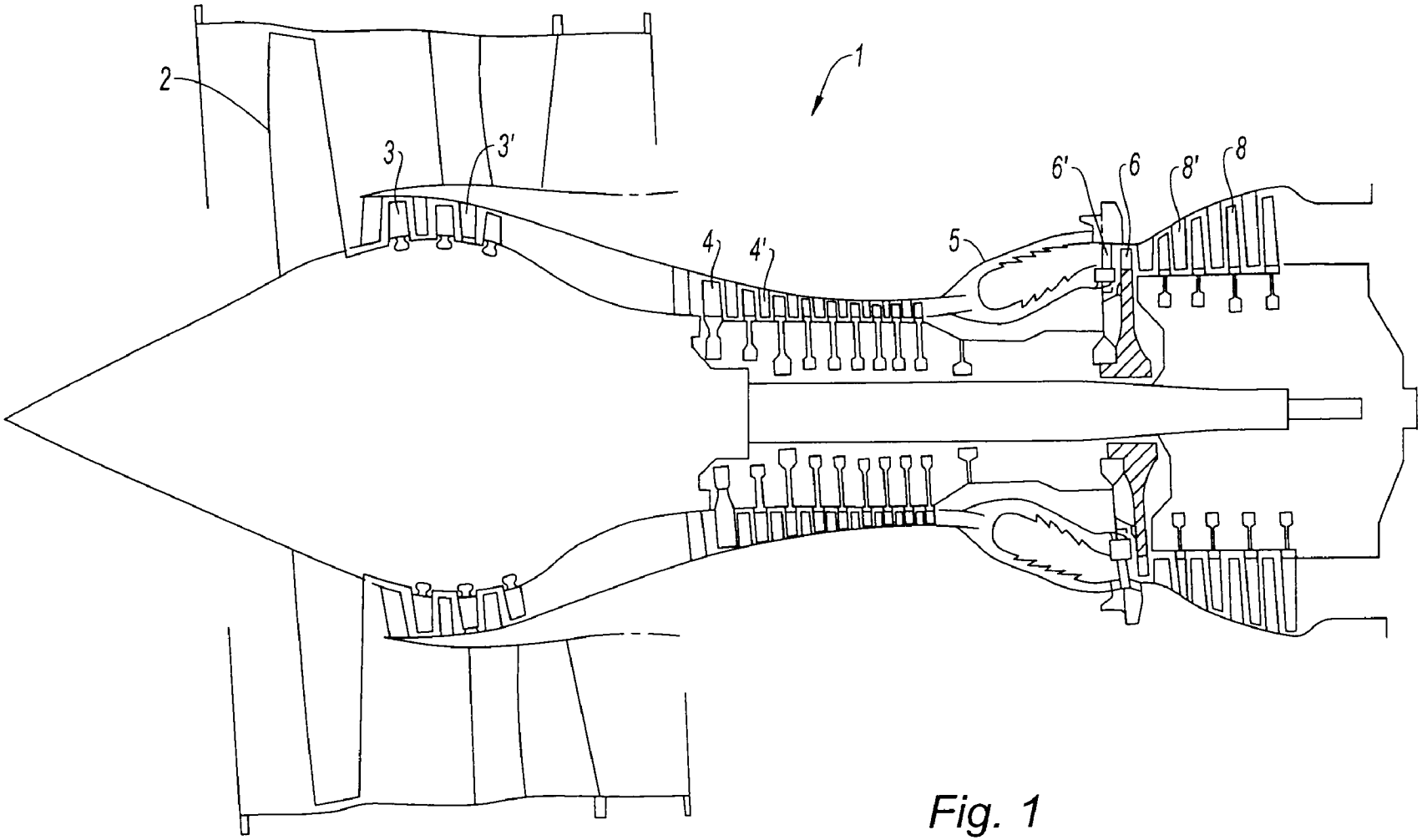
FIG. 1 schematically depicts, in axial section, a turbojet engine capable of incorporating a lever of the invention.

FIG. 1 schematically depicts one example of a turbomachine in the form of a twin spool bypass turbojet engine. A fan 2, at the front, supplies the engine with air. The air compressed by the fan is split into two concentric streams. The secondary stream is discharged directly to the atmosphere without any further supply of energy and provides an essential proportion of the motive thrust. The primary stream is guided through a number of compression stages to the combustion chamber 5 where it is mixed with fuel and burnt. The hot gases are fed to the various turbine stages 6 and 8 which drive the fan and the rotor disks of the compressor. The gases are then discharged into the atmosphere. An engine such as this comprises several flow-straightening disks: one disk downstream of the fan to straighten the secondary stream before it is discharged, bladed stator disks 3' and 4' interposed between the rotor disks 3 and 4 of the compressors and flow straighteners 6' and 8' between both the high pressure and the low pressure turbine disks.

Figure 2:
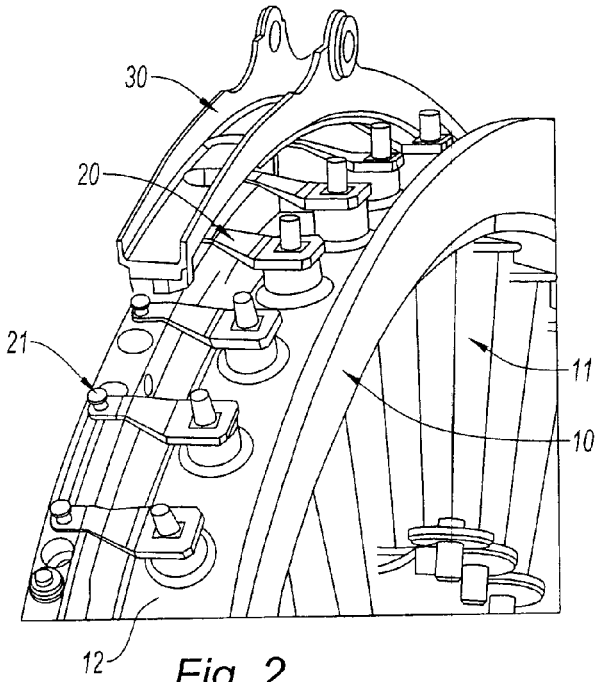
FIG. 2 is a perspective depiction of that part of the engine of FIG. 1 that corresponds to a flow straightener stage in the compressor and comprises variable-pitch stator vanes.

FIG. 2 shows a variable-pitch bladed stator disk with its drive mechanism, as formed on the initial stages of the compressor 4.

This disk 10 comprises vanes 11 positioned radially with respect to the axis of the engine 1, and mounted to pivot about radial axes within a casing sector 12. Each one rotates as one, about its radial axis, with a lever 20 positioned on the outside of the casing sector. The levers are able to rotate about these radial axes in synchronism, being driven by an assembly comprising a drive ring 30 surrounding the engine casing and to which each of the levers is fixed by its opposite end to the end that has the radial axle on which it is mounted. An appropriate means of attachment is, for example, a pin 21 passing radially both through the ring 30 and through the end of the lever. One or more actuators, not depicted, instigate the rotational movement of the ring about the engine axis. This movement is transmitted to the levers which pivot simultaneously about radial axes and cause the stator vanes to rotate about these same axes.

Figure 3:
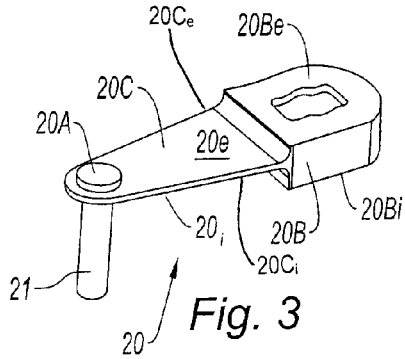
FIG. 3 shows a lever for pivoting the variable-pitch stator vanes of the flow straightener stage of FIG. 2.

FIG. 3 shows a lever 20. It is of elongate overall shape with two faces: a radially lower face 20*i* and a radially upper face 20*e*. The terms lower and upper qualify the position of these faces relative to one another from the viewpoint of the axis of the engine when the lever is in place on the engine. A distinction is drawn between three zones: the first zone 20A is pierced with a hole, through which, in this instance, the pin 21 is slipped. The second zone 20B is pierced with a radial orifice by means of which the lever is mounted on the variable-pitch vane and rotates it. It comprises a radially lower face 20Bi and a radially upper face 20Be. The third zone 20C, between the first two, is of elongate shape and more slender than the zone 20B, with a radially lower face 20Ci and a radially upper face 20Ce. The shape of the lever in the figure is merely one example. The invention applies to any equivalent shape.

Figure 4:
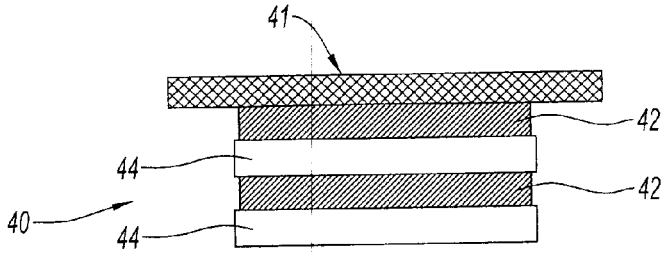
FIG. 4 is a depiction, in section, of the vibration-damping laminate applied according to the invention to a lever of FIG. 3.

FIG. 4 depicts a cross section through a vibration-damping laminate 40. The laminate is in the form of a tile made up of a number of layers stacked atop one another. According to one embodiment, the laminate comprises at least one layer 42 of a viscoelastic material and at least one layer 44 of a rigid material. The laminate is pressed via the viscoelastic layer against the surface 41 of a structure that is to be damped.

Viscoelasticity is a property of a solid or of a liquid which, when deformed, exhibits both viscous and elastic behavior by simultaneously dissipating and storing mechanical energy.

The isotropic or anisotropic elasticity properties of the rigid material of the backing layer 44 are greater than the isotropic or anisotropic properties of the viscoelastic material in the desired thermal and frequency-based operating range. By way of a non-limiting example, the material of the layer 44 may be of the metallic or composite type, and the material of the layer 42 of the rubber, silicone, polymer, glass or epoxy resin type. The material needs to be effective in terms of the dissipation of energy in the expected configuration that corresponds to determined temperature and frequency ranges. It is chosen on the basis of its characteristic shear moduli, expressed in terms of deformation and rate.

According to other embodiments, the laminate comprises several layers 42 of viscoelastic material and several backing layers of rigid material 44, which alternate with one another. The example shown in the figure depicts, non-limitingly, a vibration-damping laminate having two layers 42 of viscoelastic material and two backing layers 44 of rigid material. Depending on the application, the layers of viscoelastic material 42 and the backing layers of rigid material 44 may be of the same sizes or of different sizes. When the laminate comprises several layers 42, these may all have the same mechanical properties or may alternatively have mechanical properties that differ from one layer to another. When the laminate comprises several backing layers 44, these may all have the same mechanical properties or alternatively these may have mechanical properties that differ from one layer to another. The layers 42 and the layers 44 are fixed together preferably by adhesion using a film of adhesive, or by polymerization.

Figure 5:
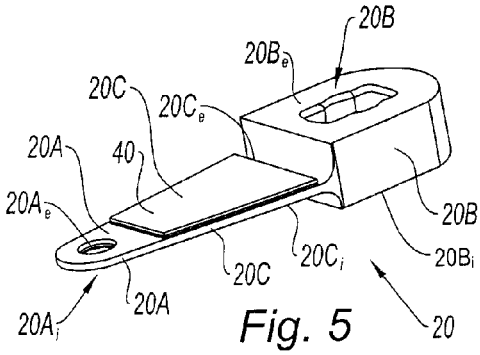
FIGS. 5 and 6 show, one in perspective and the other in lengthwise section, the lever of FIG. 3, to which the vibration-damping laminate has been applied.
Figure 6:
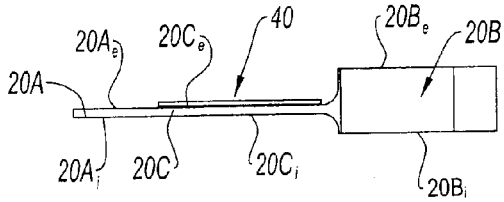

FIGS. 5 and 6 depict a first embodiment of the invention. A laminate 40 is applied to the upper face of the zone 20C of the lever 20. The laminate 40 comprises at least one layer 42 of viscoelastic material and at least one backing layer 44 of rigid material. The laminate is bonded to the lever 20 via the layer of viscoelastic material.

According to another embodiment that has not been depicted, it may be kept pressed against the surface of the lever by mechanical means: for example, by a clamping device on each side of the zone 20C, by a mechanical connection (screw/nut, rivet, crimping or the like) passed through the zone 20C of the lever and the laminate, by a preload effect obtained upon fitting by deforming the geometry at rest: fixing the zone to the zone 20B using the existing lever connection and having the zone bear with preload against the zone 20C of the lever.

The laminate extends over the entire surface of the third zone 20C of the lever. Its trapezoidal shape corresponds to the shape, again trapezoidal, of the third zone 20C of the lever between the first zone 20A and the second zone 20B. In this example, the surface portion to which the laminate is applied occupies the entire third zone. However, according to the vibration-damping requirements, the extent of the surface portion may be smaller than that of the third zone. Furthermore, the thicknesses and the nature of the materials that make up the layers 42 and 44 are determined according to the desired amount of damping.

Figure 11:
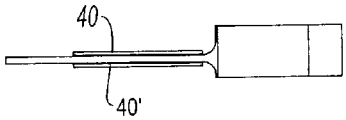
FIGS. 11, 12 and 13 show the lever of FIG. 3 with vibration-damping laminates applied to the radially lower and radially upper faces thereof.

According to another embodiment that has not been depicted, the laminate 40 is applied not to the upper face of the zone 20C of the lever but to the lower face 20Ci of the zone 20C of the lever 20. According to another embodiment depicted in FIG. 11, a vibration-damping laminate, 40 and 40', has been applied to both faces of the third zone of the lever, symmetrically.

Figure 7:
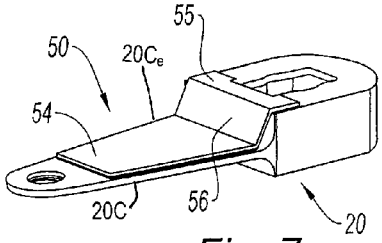
FIGS. 7 and 8 show, one in perspective and in the other in lengthwise section, another way of applying the vibration-damping laminate to the lever of FIG. 3.
Figure 8:
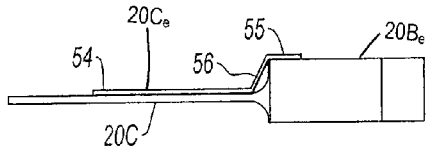
Figure 12:
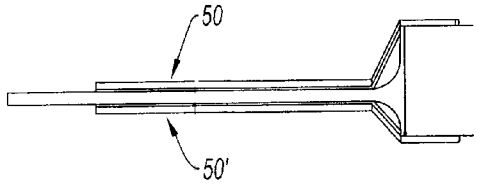

According to the embodiment of FIGS. 7 and 8, the vibration-damping laminate 50 comprises a first part 54, extending over at least a surface portion of the upper face of the third zone 20C of the lever and a second part 55 extending over at least a surface portion of the upper face 20Be of the second zone 20B. In this example, the first part 54 extends over most of the third zone 20C. Insofar as the upper surface of the second zone is radially higher up than the radially upper surface 20Ce of the third zone 20C, the laminate 20 has an intermediate part 56 connecting the first part 54 to the second part 55. This intermediate part 56 improves the effectiveness of the device by using the shear forces in the viscoelastic layer. The laminate is held against the surface of the lever by bonding, for example, at least one of the portions 54 and 55. Once again, the laminate may be applied to the lower face of the lever. According to another embodiment depicted in FIG. 12, a vibration-damping laminate 50 and 50' has been applied to both faces of the second and third zones of the lever, symmetrically.

Figure 9:
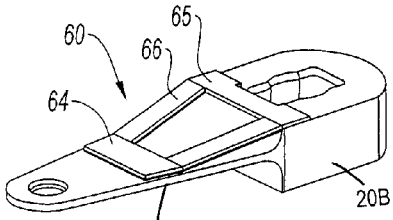
FIGS. 9 and 10 show, one in perspective and the other in lengthwise section, another way of applying the vibration-damping laminate to the lever of FIG. 3.
Figure 10:
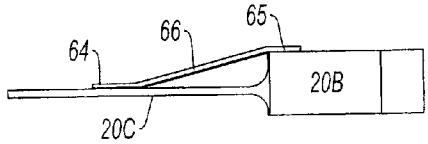
Figure 13:
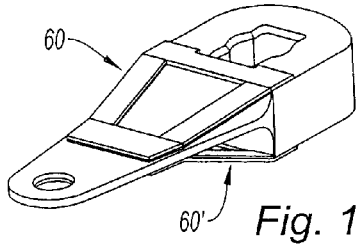

According to the embodiment of FIGS. 9 and 10, the vibration-damping laminate 60 comprises a first part 64 extending over a surface portion of the upper face of the third zone 20C, a second part 65 extending over a surface portion of the upper face of the second zone 20B. The laminate comprises an intermediate part 66 connecting the first part 64 to the second part 65. According to this example, the intermediate part is holed. The laminate is held against the surface of the lever by, for example, bonding at least one of the portions 64 and 65. Once again, the laminate may be applied to the lower face of the lever. According to another embodiment depicted in FIG. 13, a vibration-damping laminate 60 and 60' has been applied to surface portions of the two faces of the second and third zones of the lever, symmetrically.

Figure 14:
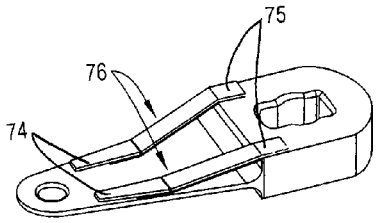
FIGS. 14 and 15 show another embodiment of damping using laminates.
Figure 15:
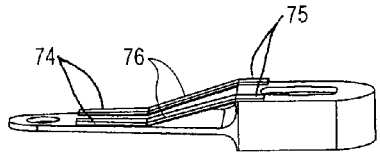

According to the embodiment of FIGS. 14 and 15, the laminate is in the form of strips positioned along the lever. The strips comprise a first part 74 applied to the third zone 20C, a second part 75 on the second zone 20B and an intermediate part 76 connecting the two parts 74 and 75 together.

The invention claimed is:

1. A lever for rotating about its pivot a turbomachine variable-pitch stator vane comprising:

a first zone for attachment to a lever drive member;

a second zone for attachment to said variable-pitch stator vane, said second zone including a radial upper face and a radial lower face; and a third zone of elongate shape between the first zone and the second zone, said third zone including a radial upper face and a radial lower face, said radial upper face of said second zone being radially higher than said radial upper face of said third zone and said radial lower face of said second zone being radially lower than said radial lower face of said third zone;

wherein a vibration-damping laminate includes a first part applied to a surface portion of the second zone of the lever, a second part applied to a surface portion of the third zone of the lever, and an intermediate part which connects the first part to the second part, a portion of the intermediate part being free of contact of the lever, and wherein the laminate includes at least one layer of viscoelastic material in contact with said surface portion and a backing layer of rigid material.

2. The lever as claimed in claim 1, wherein the vibration-damping laminate is bonded to said surface portion.

3. The lever as claimed in claim 1, wherein the vibration-damping laminate is kept pressed against said surface portion by a mechanical device.

4. The lever as claimed in claim 1, wherein the second part of the vibration-damping laminate entirely covers the surface portion of said third zone.

5. The lever as claimed in claim 1, comprising at least one vibration-damping laminate in the form of strips, at least two of these, of a width narrower than the width of the third zone.

6. The lever as claimed in claim 1, wherein the laminate is made up of a stack of viscoelastic layers and of rigid layers in alternation, the characteristics of the viscoelastic material varying or being the same from one layer to another.

7. The lever as claimed in claim 6, wherein the characteristics of the rigid material vary from one layer to another.

8. A turbomachine comprising at least one lever as claimed in claim 1 for rotating a variable-pitch stator vane about its pivot.

9. A gas turbine engine compressor comprising at least one lever as claimed in claim 1 for rotating a variable-pitch flow straightener vane about its pivot.

10. The lever as claimed in claim 1, wherein edges along a thickness of the second zone and edges along a thickness of the third zone are free of the laminate.

* * * * *